US009821547B2

(12) United States Patent
Messer et al.

(10) Patent No.: US 9,821,547 B2
(45) Date of Patent: Nov. 21, 2017

(54) PRINTING BLANKET WITH NON-EXTENSIBLE BACKING MOUNTABLE IN A SINGLE REEL ROD LOCK-UP

(71) Applicant: Day International, Inc., Plymouth, MI (US)

(72) Inventors: James Messer, Canton, NC (US); Brian James, Fairview, NC (US); Thomas Smatlak, Fond du Lac, WI (US)

(73) Assignee: Day International, Inc., Plymouth, MI (US)

( * ) Notice: Subject to any disclaimer, the term of this patent is extended or adjusted under 35 U.S.C. 154(b) by 428 days.

(21) Appl. No.: 14/105,365

(22) Filed: Dec. 13, 2013

(65) Prior Publication Data

US 2014/0299010 A1 Oct. 9, 2014

(51) Int. Cl.

| | |
|---|---|
| ***B41N 10/06*** | (2006.01) |
| ***B41F 30/04*** | (2006.01) |
| *B41F 27/12* | (2006.01) |
| *B41N 10/02* | (2006.01) |
| *B41N 10/04* | (2006.01) |

(52) U.S. Cl.

CPC ..... *B41F 30/04* (2013.01); *B41F 27/125* (2013.01); *B41N 10/06* (2013.01); *B41F 27/12* (2013.01); *B41N 10/02* (2013.01); *B41N 10/04* (2013.01); *B41N 2210/06* (2013.01); *B41N 2210/10* (2013.01)

(58) Field of Classification Search

CPC ..... B41F 30/00

See application file for complete search history.

(56) References Cited

U.S. PATENT DOCUMENTS

| | | | | |
|---|---|---|---|---|
| 4,635,550 | A | 1/1987 | Brands et al. | |
| 4,829,896 | A | 5/1989 | Norkus | |
| 5,787,812 | A * | 8/1998 | Shoji | 101/415.1 |
| 6,530,321 | B2 | 3/2003 | Andrew et al. | |
| 8,783,178 | B2 * | 7/2014 | Czerner | 101/376 |
| 2006/0230961 | A1 * | 10/2006 | Grieser et al. | 101/382.1 |
| 2007/0101884 | A1 | 5/2007 | Czerner | |

OTHER PUBLICATIONS

Search Report/Written Opinion—PCT/US2014/051800—dated Nov. 5, 2014.

* cited by examiner

*Primary Examiner* — Jill Culler

(74) *Attorney, Agent, or Firm* — Dinsmore & Shohl LLP

(57) ABSTRACT

Printing blankets having non-extensible backing plies such as, for example, metalback blankets, are provided which have a construction that is adapted to be mountable onto blanket cylinders having a gap containing a conventional single reel rod lock-up mechanism. The blankets include first and second relief areas positioned such that when the blankets are mounted onto a blanket cylinder, the relief areas substantially align with the point at which the lead and trail ends of the blankets are inserted into a gap in the blanket cylinder to secure the ends in the lock-up mechanism.

11 Claims, 5 Drawing Sheets

PRINTING BLANKET WITH NON-EXTENSIBLE BACKING MOUNTABLE IN A SINGLE REEL ROD LOCK-UP

BACKGROUND

The subject matter described herein relates to printing blankets having non-extensible backing plies such as, but not limited to metal, and more particularly to such blankets having a construction adapted to be mountable onto blanket cylinders using conventional single reel rod lockup mechanisms.

One of the most common commercial printing processes is offset lithography. In this printing process, ink is offset from a printing plate to a rubber-surfaced printing blanket mounted on a blanket cylinder before being transferred to a substrate, such as paper. Typically, the blanket cylinder comprises a chrome nickel-plated or stainless steel cylinder having a longitudinal opening or "gap" therein. An encircling rubber printing blanket is releasably mounted onto the cylinder with opposing ends of the blanket being fed into the cylinder gap and secured by a locking mechanism within the gap. The printing blanket is typically reinforced with a number of fabric and/or rubber plies along with either a fabric, metal, or other non-extensible backing. The use of a metal backing is often preferable as it prevents stretching of the blanket when it is mounted on the blanket cylinder. The metal backing also provides dimensional stability to the blanket, resulting in high print quality, eliminates the need for frequent re-tensioning of the blanket as would be required with conventional fabric-backed blankets and improves printing to the edge of the blanket cylinder gap.

There are currently a number of different types of lockup mechanisms used in the printing industry to secure printing blankets into the cylinder gap. In most conventional presses, blanket bars are typically secured to each end of the blanket and the ends are inserted into the blanket cylinder gap and secured with a lockup device.

In recent years, manufacturers of offset printing presses have equipped newer presses with a "plate" type lockup mechanism which allows the use of metal-backed or non-tensioned blankets and which achieves a very narrow printing gap. The use of the newer presses in combination with a metal-backed blanket provide faster printing speed, reduced press vibrations, higher quality print, longer blanket life, and reduced non-print length compared to standard tensioned blankets which are used with conventional bar lockup devices.

However, blankets containing a metal backing are difficult to mount and tension properly on a blanket cylinder which uses more conventional mounting mechanisms such as single or dual reel rods or "t-bar" type lockups. This is due to the metal at the leading and trailing ends of the blanket which is relatively inflexible as compared to conventional fabric-backed blankets and is difficult to feed into the cylinder gap. In addition, the stiffness of the metal-backed blankets makes it difficult to mount the blankets around small diameter printing cylinders, and the bending required to insert the blanket ends into lock up mechanisms may cause rupturing of the metal layer from the other layers in the blanket. Further, the ends of metalback blankets have a tendency to pull out or release from many locking mechanisms during high speed printing operations.

Andrew et al., U.S. Pat. No. 6,530,321 describes various embodiments of printing blankets having non-extensible (metal or polymer) backings. The blankets include reinforcing fabric layers in which the weft and warp fibers of the fabric plies are oriented such that the blankets have greater flexibility to enable easier lock-up. The blankets include different end treatments to be able to be mounted in different locking mechanisms. In one embodiment, the blanket ends include blanket bars thereon to enable lock-up in a single reel rod mechanism. However, the relatively inflexible metal base at the leading and trailing ends of the blanket makes it difficult for an operator to feed the ends into the gap in the cylinder for lockup. Additionally, the stiffness of metalback blankets makes them more difficult to mount around smaller diameter blanket cylinders.

Czerner, US Pub. No. 2007/0101884, describes embodiments of printing blankets having non-extensible polymer base layers to address the mounting difficulties encountered using relatively inflexible metalback blankets. Relief areas are provided at adjacent and opposite ends of the blankets so that the other blanket layers are not subjected to tensioning forces which may cause a gauge reduction in the blanket at the blanket cylinder gap.

Accordingly, there is still a need in the art for a printing blanket having a non-extensible backing ply such as a metalback, or other non-extensible backed, blanket which has a construction which may be easily and securely mounted into the gap of a blanket cylinder that uses a conventional single reel rod lock-up mechanism.

BRIEF SUMMARY

Those needs are addressed by embodiments of the present invention which provide a blanket construction that is easily and securely mountable into the gap of a blanket cylinder using a conventional single reel rod lock-up mechanism.

In accordance with one embodiment of the present invention, a printing blanket is provided and comprises at least a printable surface layer and a non-extensible backing layer. By "non-extensible," it is meant that the dimensions of the backing ply substantially resist stretching when conventional forces are encountered during normal mounting and operation of the blanket, particularly in the circumferential direction around the blanket cylinder. The printable surface layer, along with any other additional optional layers as described below, may also be referred to as the "blanket carcass."

The printing blanket has opposing lead and trail ends which are adapted to be inserted into the gap of a printing blanket cylinder. The lead end of the blanket includes a first relief area which is positioned inwardly from the lead end and extends substantially across the width of the blanket. The first relief area is defined by a gap in the blanket carcass that overlies the non-extensible backing layer and is bounded on either side by blanket walls. On the opposing end of the blanket, the non-extensible backing layer extends beyond the trail end of the blanket. The trail end includes a second relief area positioned inwardly from the trail end and extends substantially across the width of said blanket. The second relief area is defined by a gap in the blanket carcass that overlies the non-extensible backing layer and is bounded on either side by blanket walls. The first and second relief areas are positioned such that when the blanket is inserted into the blanket cylinder gap and mounted on the blanket cylinder, the relief areas substantially align with the point at which the lead and trail ends of the blanket are inserted into the gap in the blanket cylinder.

Alternatively, the blanket may be fabricated so that the non-extensible backing layer extends beyond the blanket carcass at both of the lead and trail ends of the blanket. Separate layers of material may be positioned on the non-extensible layer and adhered or laminated thereto such that they are spaced from the respective ends of the blanket carcass to form the first and second relief areas. These spaced layers function to bring the lead and trail ends of the blanket into frictional engagement in the lock-up mechanism as will be explained in greater detail below. The separate layers of material may comprise rubber, polymer, or other suitable material. For example, one or more layers of an adhesive fluoropolymer tape may be used to build up an appropriate thickness for the blanket construction.

In some embodiments, the printing blanket includes one or more compressible plies positioned beneath the printing surface layer, and at least one reinforcing ply comprised of fabric, non-wovens, or polymeric materials positioned beneath said printing surface layer. Preferably, the non-extensible backing layer comprises a metal or metal alloy, polymer, or other suitable non-extensible material in the form of a relatively thin sheet.

In another embodiment of the invention, the printing blanket is mounted on a blanket cylinder which includes a gap and a single reel rod lock-up mechanism within the gap. The lock-up mechanism includes a lead end shelf formed in the gap and a rotatable rod positioned in the gap opposite the shelf and which has a recess or slot therein. The printing blanket comprises the same construction as described above, including at least a printable surface layer and a non-extensible backing layer, and opposing lead and trail ends adapted to be inserted into the gap of the printing blanket cylinder.

The lead and trail ends of the blanket include blankets bars attached thereto. The lead end of the blanket is inserted into the gap in the cylinder such that an edge of the blanket bar on the lead end of the blanket engages the shelf in the gap in the cylinder. The blanket bar on the opposing trail end of the blanket is inserted into the recess in the rotatable rod, and the rod is rotated to tighten the blanket against the circumferential surface of the blanket cylinder and to securely lock the trail end of the blanket into the lock-up mechanism.

The rotation of the rod also causes the surfaces of the lead and trail ends of the blanket to come together in the gap in frictional engagement with one another. This frictional engagement enhances the security of the lock-up and prevents the lead and trail ends of the blanket from pulling out or releasing from the lock-up mechanism.

Accordingly, it is a feature of the present invention to provide a blanket construction that is easily and securely mountable into the gap of a blanket cylinder using a conventional single reel rod lock-up mechanism. Other features and advantages of the present invention will be apparent from the following detailed description, the accompanying drawings, and the appended claims.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

Figure 1:
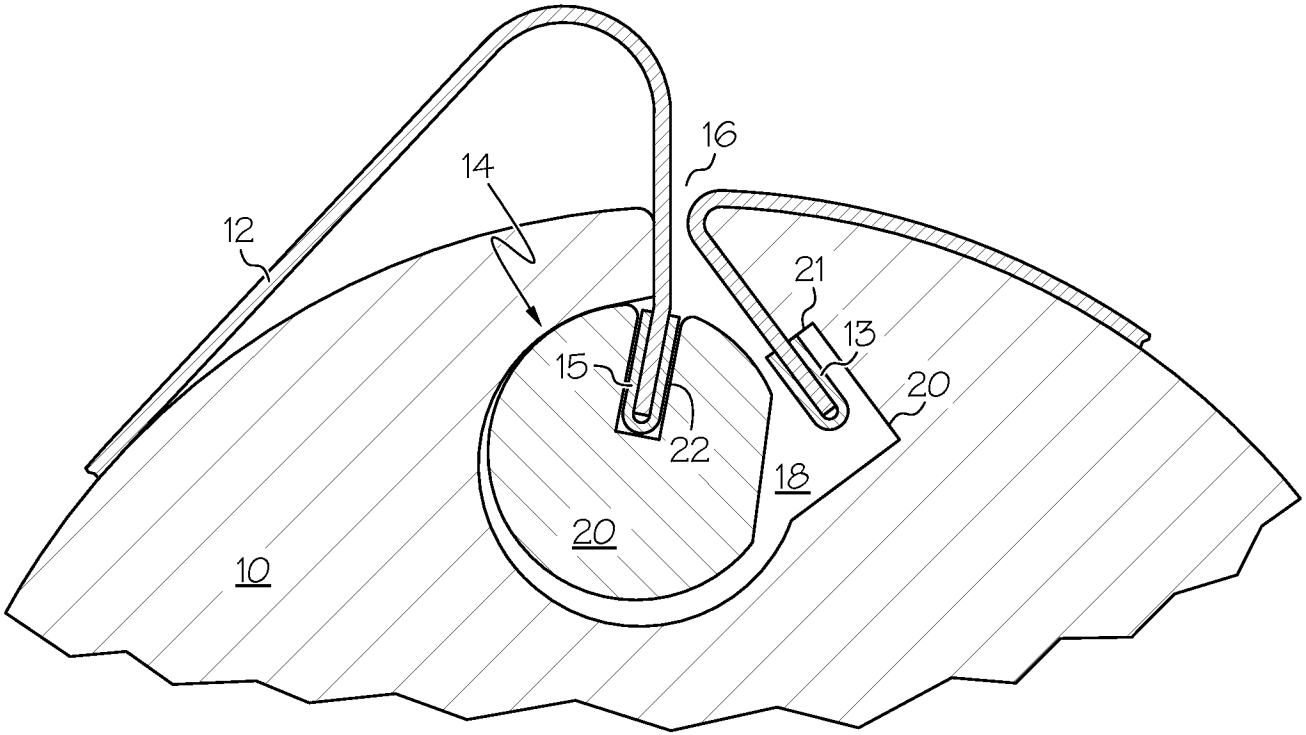
FIG. 1 (PRIOR ART)
FIG. 1 is a schematic side view of a prior art conventional pliable tensioned blanket that is to be mounted onto a blanket cylinder using a conventional single reel rod lock-up mechanism.
Figure 2:
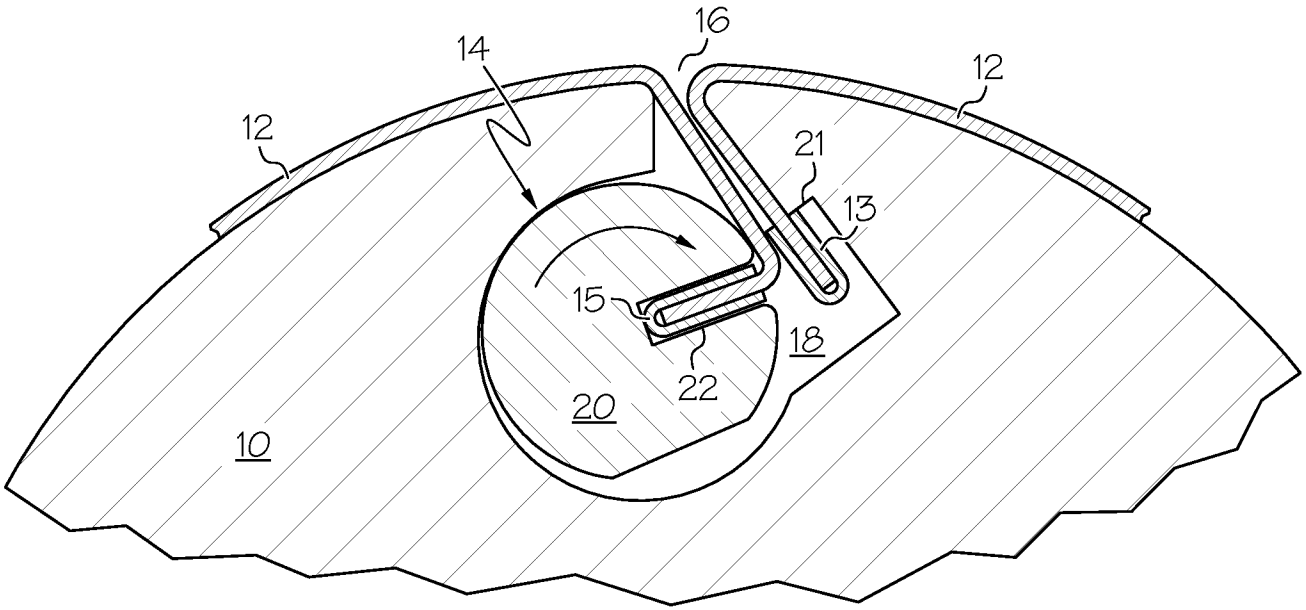
FIG. 2 (PRIOR ART)
FIG. 2 is a schematic side view of a prior art conventional pliable tensioned blanket tensioned and mounted onto a blanket cylinder using a conventional single reel rod lock-up mechanism.

FIGS. 1 and 2 illustrate a conventional blanket cylinder 10 having a conventional fabric-backed printing blanket 12 to be mounted thereon using a single reel rod lockup mechanism 14. Blanket 12 includes at least a print surface layer and a reinforcing fabric backing ply. Conventional printing blankets may also include additional plies or layers (not shown) as is well known in the art. Lead and trail blanket bars 13 and 15 are secured to opposite ends of the blanket. As is conventional, a blanket bar is typically formed from metal and is used to reinforce the ends of a printing blanket and as an aid in inserting and securing the blanket ends in the lock-up mechanism.

The gap 16 in the cylinder extends radially inwardly from the surface of the cylinder to form a recess 18 in which the cam-operated lockup mechanism is located. Gap 16 and recess 18 extend substantially the entire width of the blanket cylinder. The single reel lockup includes a rotatable cam 20 having a slot or recess 22 therein. Recess 18 includes a shelf or cut-out 21 against which an edge of the lead end blanket bar 13 is mounted. The trail end blanket bar 15 is inserted into slot 22, and, as best shown in FIG. 2, rotation of cam 20 in the direction of the arrow causes the trail end of the blanket to tighten against the surface of blanket cylinder 10. Further rotation results in tensioning of the blanket as it becomes locked around the outer circumference of cylinder 10.

A problem with prior conventional fabric-backed blankets is that they tend to stretch when subjected to the rapid rotation of the blanket cylinder during printing operations. This stretching requires an operator to frequently shut down press operation so that the blanket can be re-tensioned and print quality maintained. The use of a non-extensible backing, such as a metal or other non-extensible backing, on a printing blanket addresses this problem, and the metal backing layer prevents stretching of the blanket after mounting on the blanket cylinder and during operation. The metal backing also provides dimensional stability to the blanket, resulting in high print quality, and eliminates the need for frequent re-tensioning of the blanket as would be required with conventional fabric-backed blankets.

Figure 3:
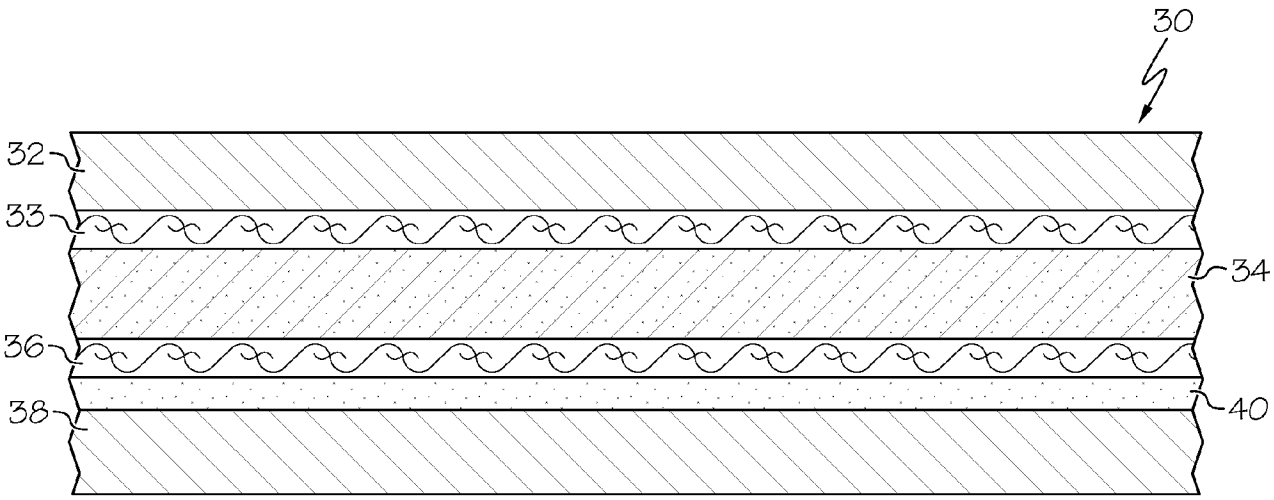
FIG. 3 is a cross-sectional side view of a typical printing blanket including a at least a surface print layer and a non-extensible backing layer in accordance with one embodiment of the invention.

FIG. 3 shows a cross-sectional view of one embodiment of the printing blanket construction 30 of the present invention. Printing blanket 30 includes at least an outer printing surface layer 32 which acts to transfer an inked image from a printing plate to a substrate and a non-extensible backing layer 38. As shown in this embodiment, blanket 30 may also optionally include one or more compressible plies 34 and one or more reinforcing plies such as fabric plies 33 and 36. As shown, the plies 32, 34 and 36 are adhered to non-extensible backing layer 38 with an adhesive 40. The adhesive used to adhere the plies to the non-extensible backing layer may comprise any of a number of conventional adhesives including hot melt adhesives, pressure sensitive adhesives, and curable polymers including rubber, urethane, epoxies, and the like. Alternatively, the plies may be formed directly onto the non-extensible backing layer. Preferably the blanket has an overall thickness of from about 0.070 to about 0.090 inches (about 1.75 to about 2.30 mm).

The non-extensible backing layer 38 preferably comprises a flexible, but non-extensible material such as a thin metal or metal alloy sheet or other non-extensible material such as a polymeric material. A preferred material for backing layer 38 is stainless steel having a thickness of from between about 0.006 to about 0.010 inches (about 0.15 to about 0.25 mm), which material is readily commercially available. Other materials may be used, so long as they are substantially non-extensible in use under normal operating conditions and so long as they have sufficient flexibility to be mounted onto conventional blanket cylinders.

Preferably, the adhesive material 40 has a thickness of from approximately 0.001 to 0.008 inches (about 0.025 mm to about 0.2 mm) and may comprise any suitable adhesive including, but not limited to a pressure sensitive adhesive or a hot melt film which can be applied and then heated to an elevated temperature to activate its adhesive properties. Suitable adhesive are commercially available from a number of manufacturers. For example, one suitable adhesive material 40 may comprise a modified co-polymer of ethylene and vinyl acetate in the form of a hot-melt film.

Woven fabric ply 36 may be partially or entirely ground to adjust the thickness thereof. Fabric plies 33 and 36 have thicknesses, respectively, preferably in a range from about 0.008 to about 0.016 inches (from about 0.20 to about 0.4 mm) and most preferably, a thickness of about 0.011 inches (0.28 mm). Reinforcing plies 33 and 36 can comprise fabrics woven from cotton or synthetic yarns or fibers having both warp and weft fibers or yarns. One preferred fabric for use in the present invention is a square woven fabric in which the warp yarns are cotton (such as, for example, pima cotton) and the weft yarns are polyester (such as a spun polyester). The fabric is pre-stretched in a single direction along the length of the warp yarns such that the fabric as used in the manufacture of the image transfer blanket has little or no residual stretch in that direction.

As taught in commonly-assigned U.S. Pat. No. 6,530,321 to Andrew et al., either or both of woven fabric plies 33 and 36 may be oriented in the blanket construction so that when the blanket is mounted onto blanket cylinder 10, the weft fibers extend circumferentially about the cylinder. This orientation is 90° from the orientation of conventional fabric plies in a blanket (as that blanket would be mounted onto a cylinder) and provides additional flexibility for the blanket 12.

With respect to the compressible layer 34, any known compressible or resilient material compatible with the other plies may be used in accordance with embodiments of the invention. A preferred compressible layer 34, comprises a blend of nitrile and chloroprene-based rubber having a pore density to provide adequate strength and compressibility. Compressible layer 34 may comprise either open or closed-cell foam, with closed cell foams being preferred. Suitable compressible layer materials and their methods of fabrication include those materials disclosed in commonly-assigned U.S. Pat. No. 4,548,858 to Meadows, the disclosure of which is hereby incorporated by reference.

Alternatively, the compressible layer may be formed by mixing a suitable salt such as hydrated magnesium sulfate with a polymeric material such as rubber and then curing and leaching the salt out, forming cavities in the rubber. Such a process is disclosed in commonly assigned U.S. Pat. No. 3,928,521 to Haren et al, the disclosure of which is hereby incorporated by reference. Still another method of forming the cushion layer includes the incorporation of microcapsules in an elastomeric matrix and fixing those microcapsules in a low temperature partial vulcanization step as described in U.S. Pat. No. 4,770,928 to Gaworoski, the disclosure of which is hereby incorporated by reference. Preferably, compressible layer 34 will have a thickness in a range from about 0.022 to about 0.026 inches (from about 0.56 mm to about 0.67 mm) and most preferably, a thickness of about 0.245 inches (0.62 mm).

Elastomeric image transfer surface layer 32 provides the image transfer face for the image transfer blanket 30. The surface of layer 32 may be ground to provide the final gauge thickness for the blanket. Suitable materials for use in the fabrication of image transfer surface layer 32 include a number of different polymers such as butyl rubber, EPDM rubber, nitrile rubber, natural rubber, neoprene rubber, a blend of nitrile and polyvinyl chloride, polyurethane, and synthetic rubber.

Those skilled in the art will appreciate that the preferred materials and their respective thickness may be varied or substituted without departing from the spirit of the invention. For example, additional adhesive, primer, anchor, and ply up layers may be provided in the blanket construction as needed and as is conventional in this art.

One method for securing the plies to non-extensible base layer 38 uses an adhesive film material. The adhesive may comprise a hot melt material, a pressure sensitive adhesive, or both. For example, it is possible to use an adhesive in which one side of a thin film support includes hot melt material while the other side includes a pressure sensitive adhesive. The method includes first removing any oils or other contaminants from the surface of base layer 38. Then, a primer is applied to prevent the reoccurrence of surface contamination and increase the ability of the adhesive film material 40 to bond. The adhesive film material 40, which can be a hot melt film, a pressure sensitive adhesive, or a combination of both as described above, is interleaved between reinforcing ply 36 and non-extensible base layer 38. It should be understood, however, that it is possible to apply an initial layer of the adhesive to a side of the reinforcing ply 36 to which base layer 38 is adhered so as to provide a "priming" adhesive film layer. Thereafter, the blanket plies and base layer 38 are heated and then cooled to set the adhesive film material 40, thus adhesively securing the plies to base layer 38 resulting in a preferred image transfer blanket construction. Other suitable methods of adhering the blanket layers together are known in this art and may also be used.

Figure 4:
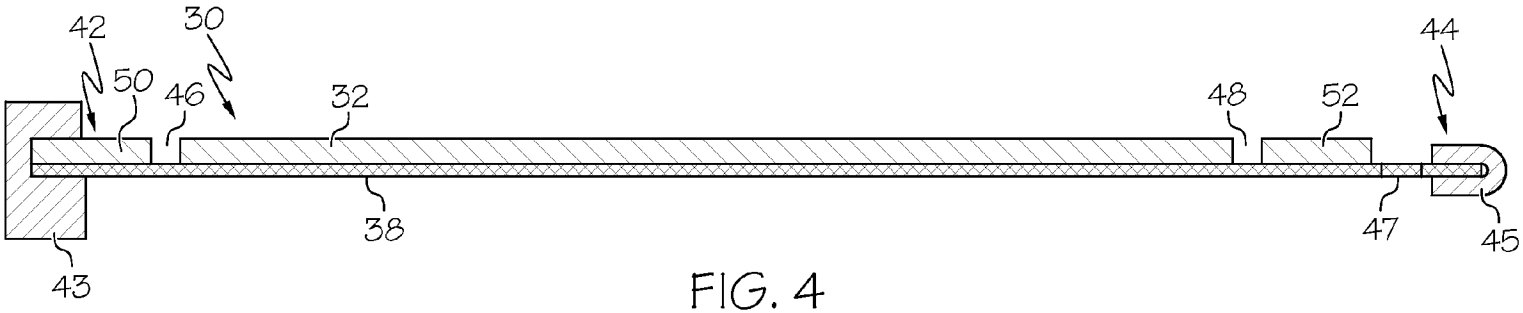
FIG. 4 is cross-sectional side view of a printing blanket in accordance with one embodiment of the invention illustrating the positioning of blanket bars and relief areas adjacent to the lead and trail ends of the blanket.

FIG. 4 illustrates a sectional side view of one embodiment of the invention showing the location of the relief areas on the blanket. As shown, blanket 30 includes at least a printable surface layer 32 and a non-extensible backing layer 38, preferably of a metal or metal alloy or other non-extensible material. The blanket 30 has a lead end 42 and a trail end 44 which are both adapted to be inserted into the gap of a printing blanket cylinder (as will be explained in greater detail below). Lead end 42 has a blanket bar 43 attached thereto, and trail end 44 has a blanket bar 45 attached thereto. As shown, blanket bar 43 is secured around separated portion 50 of the blanket carcass as well as non-extensible layer 38. Blanket bar 45 is secured directly to opposing surfaces of non-extensible layer 38.

The lead end 42 of the blanket includes a first relief area 46 positioned inwardly from the lead end and extends substantially across the width of the blanket. The first relief area 46 is defined by a gap in the surface print layer 32 (as well as in any other optional layers which are not shown) of the blanket, the gap overlies the non-extensible backing layer 38 and is bounded on either side by blanket walls of the surface print layer.

The non-extensible backing layer 38 has a portion 47 which extends beyond the blanket carcass 32 on the trail end 44 of the blanket. The trail end 44 includes a second relief area 48 which is positioned inwardly from the trail end and extends substantially across the width of the blanket. The second relief area 48 is defined by a gap in the surface print layer (as well as in any additional optional layers which are not shown) of the blanket that overlies the non-extensible backing layer 38. Second relief area 48 is bounded on either side by blanket walls of the surface print layer.

As is known in the art, the total length of the blanket 30 will be dependent on the circumference of the blanket cylinder to which it is to be mounted. Typically such blankets will have overall lengths of from about 400 to about 1500 mm. Also, in general, the first and second relief areas will form gaps of from about 0.25 to about 10 mm, and preferably about 5 mm. The trail end of the non-extensible backing layer will extend from about 0 to about 25 mm, and preferably about 22 mm, beyond the end of the surface print layer.

First and second relief areas 46 and 48, respectively, may be formed by removing portions of the blanket carcass so that the relief areas extend substantially across the entire surface of the blanket. Suitable removal methods include laser scribing or a water jet. Alternatively, the blanket may be constructed so that the opposite ends of non-extensible layer 38 extend beyond printing surface layer 32 of the blanket. Portions 50 and 52 may then be added to the blanket construction using suitable materials including rubber or other polymeric material. For example, portions 50 and 52 may be fabricated using a fluoropolymer adhesive tape, with appropriate layers of the tape being used to build up the thickness of portions 50 and 52 as needed.

Figure 5:
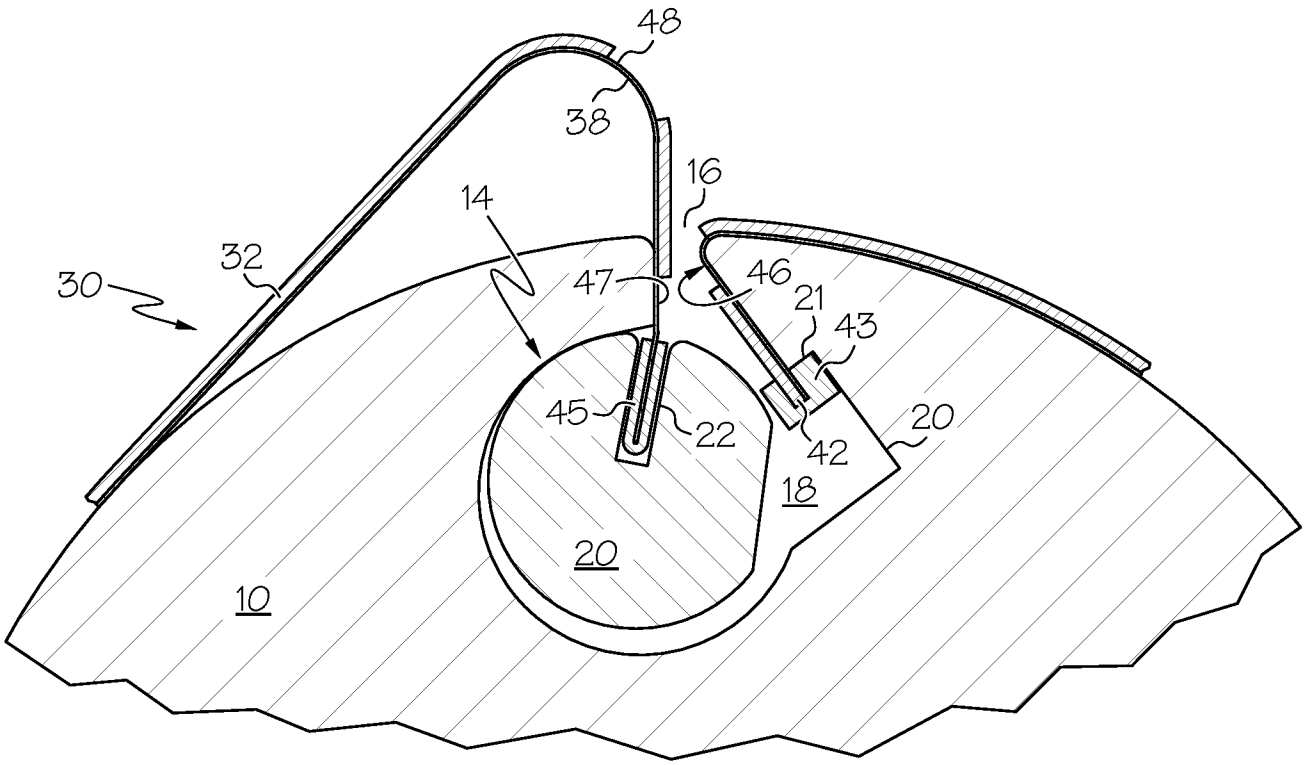
FIG. 5 is a schematic side view of a printing blanket in accordance with one embodiment of the invention that is to be mounted onto a blanket cylinder using a conventional single reel rod lock-up mechanism.
Figure 6:
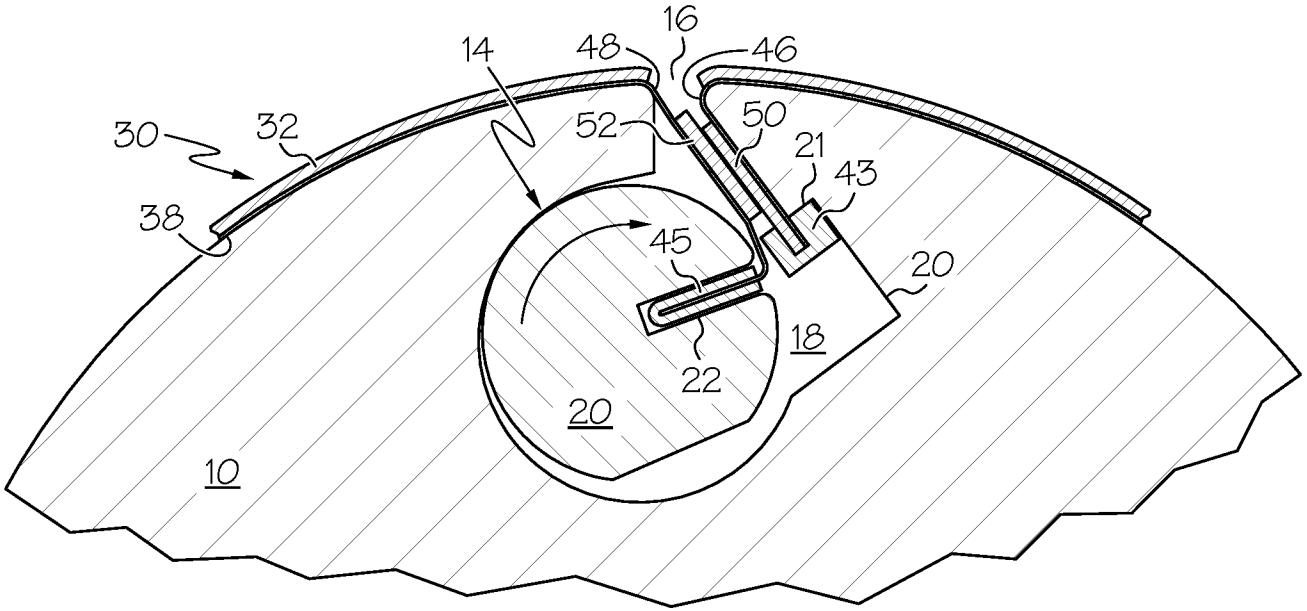
FIG. 6 is a schematic side view of a printing blanket mounted onto a blanket cylinder using a conventional single reel rod lock-up mechanism.

As shown in FIGS. 5 and 6, the first and second relief areas 46, 48 are positioned such that when the blanket 30 is mounted on the blanket cylinder, the relief areas substantially align with the point at which the lead and trail ends of the blanket are inserted into the gap in the blanket cylinder. Turning first to FIG. 5, blanket 30 is to be mounted onto blanket cylinder 10 using single reel rod lock-up mechanism 14. Blanket 30 includes at least a surface print layer 32 and a non-extensible backing layer 38 which is preferably a thin metal sheet or other non-extensible material. Blanket 30 also includes lead 42 and trail 44 ends, with blanket bars 43 and 45 attached to the respective lead and trail ends of the blanket.

The gap 16 in blanket cylinder 10 extends radially inwardly from the surface of the cylinder to form a recess 18 in which the cam operated lock-up mechanism is located. Gap 16 and recess 18 extend substantially the entire width of the blanket cylinder. The single reel rod lock-up includes a rotatable cam 20 having a slot or recess 22 therein. Recess 18 includes a shelf or cut-out 21 against which an edge of the lead blanket bar 43 is mounted. The trail end blanket bar 45 is inserted into slot 22. First 46 and second 48 relief areas on opposing lead and trail ends of the blanket permit the blanket ends to be easily bent and inserted into recess 18.

As best shown in FIG. 6, rotation of cam 20 in the direction of the arrow causes the trail end 44 of the blanket to tighten against the outer circumference of blanket cylinder 10. Further rotation results in securing the blanket ends in the lock-up mechanism such that portions 50 and 52 are brought into engagement and the blanket is ready for printing operations. As shown in FIG. 6, relief areas 46 and 48 substantially align with the point at which the lead and trail ends of the blanket are inserted into gap 16 in the cylinder, leaving a narrow gap for printing purposes. As also shown in FIG. 6, the respective portions 50 and 52 of the surface print layer which are positioned beyond the respective relief areas now meet in the gap in frictional engagement with one another to aid in securing the blankets ends in the lock-up mechanism.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A printing blanket comprising at least a printable surface layer and a non-extensible backing layer, said printing blanket having lead and trail ends adapted to be inserted into the gap of a printing blanket cylinder; said lead end of said blanket including a first relief area positioned inwardly from said lead end and extending substantially across the width of said blanket, said first relief area defined by a gap in the blanket carcass and bounded on either side by blanket walls; said lead end of said blanket including a blanket bar extending around said blanket carcass and said non-extensible backing layer; said non-extensible backing layer extends beyond said blanket carcass on said trail end of said blanket; said blanket including a second relief area positioned inwardly from said trail end and extending substantially across the width of said blanket, said second relief area defined by a gap in the blanket carcass and bounded on either side by blanket walls, said first and second relief areas positioned such that when said blanket is mounted on said blanket cylinder, said relief areas substantially align with the point at which the lead and trail ends of said blanket are inserted into said gap in said blanket cylinder.

2. The printing blanket of claim 1 wherein said blanket carcass includes a compressible ply positioned beneath said surface layer.

3. The printing blanket of claim 2 wherein said blanket carcass includes at least one reinforcing ply.

4. The printing blanket of claim 3 in which said reinforcing ply is selected from the group consisting of woven fabric, non-woven material, and polymers.

5. The printing blanket of claim 1 including a blanket bar on said trail end of said blanket.

6. The printing blanket of claim 1 wherein said non-extensible backing layer comprises metal or other non-extensible material.

7. In combination, a printing blanket mounted on a blanket cylinder which includes a gap and a single reel rod lock-up mechanism within said gap, said lock-up mechanism including a lead end shelf and a rotatable rod having a recess therein opposite said shelf; said printing blanket comprising at least a printable surface layer and a non-extensible backing layer, said printing blanket having lead and trail ends adapted to be inserted into the gap of a printing blanket cylinder, each of said lead and trail ends of said blanket including a blanket bar attached thereto; said lead end of said blanket including a first relief area positioned inwardly from said lead end and extending substantially across the width of said blanket, said first relief area defined by a gap in the blanket carcass and bounded on either side by blanket walls; said non-extensible backing layer extends beyond said blanket carcass on said trail end of said blanket; said blanket including a second relief area positioned inwardly from said trail end and extending substantially across the width of said blanket, said second relief area defined by a gap in the blanket carcass and bounded on either side by blanket walls, wherein respective portions of said blanket carcass which are positioned beyond said first and second relief areas meet in frictional engagement in said gap in said blanket cylinder.

8. The combination of claim 7 in which an edge of said blanket bar on said lead end of said blanket engages said shelf.

9. The combination of claim 7 in which said blanket bar on said trail end of said blanket is inserted into the recess in said rotatable rod, and said rod is rotated to lock the ends of said blanket into said lock-up mechanism.

10. The combination of claim 9 in which rotation of said rod causes the surfaces of portions of the lead and trail ends of said blanket to come together in said gap in said blanket cylinder in frictional engagement.

11. A printing blanket comprising at least a printable surface layer and a non-extensible backing layer, said printing blanket having lead and trail ends adapted to be inserted into the gap of a printing blanket cylinder; said lead end of said blanket including a first relief area positioned inwardly from said lead end and extending substantially across the width of said blanket, said first relief area defined by a gap in the blanket carcass and bounded on either side by blanket walls; said non-extensible backing layer being coextensive with the end of said blanket carcass on said lead end and extending beyond said blanket carcass on said trail end of said blanket; said blanket including a second relief area positioned inwardly from said trail end and extending substantially across the width of said blanket, said second relief area defined by a gap in the blanket carcass and bounded on either side by blanket walls, said first and second relief areas positioned such that when said blanket is mounted on said blanket cylinder, said relief areas substantially align with the point at which the lead and trail ends of said blanket are inserted into said gap in said blanket cylinder.

* * * * *